US012435425B2

(12) United States Patent
Sievi et al.

(10) Patent No.: US 12,435,425 B2
(45) Date of Patent: Oct. 7, 2025

(54) PREPARATIONS OF NOBLE METAL COMPLEXES

(71) Applicant: Heraeus Deutschland GmbH & Co. KG, Hanau (DE)

(72) Inventors: Robert Sievi, Hanau (DE); Michael Gock, Hanau (DE); Richard Walter, Hanau (DE)

(73) Assignee: HERAEUS DEUTSCHLAND GMBH & CO. KG, Hanau (DE)

( * ) Notice: Subject to any disclaimer, the term of this patent is extended or adjusted under 35 U.S.C. 154(b) by 50 days.

(21) Appl. No.: 18/004,581

(22) PCT Filed: Apr. 26, 2021

(86) PCT No.: PCT/EP2021/060795
§ 371 (c)(1),
(2) Date: Jan. 6, 2023

(87) PCT Pub. No.: WO2022/012794
PCT Pub. Date: Jan. 20, 2022

(65) Prior Publication Data

US 2023/0243038 A1 Aug. 3, 2023

(30) Foreign Application Priority Data

Jul. 13, 2020 (EP) ..... 20185479

(51) Int. Cl.
*C23C 18/12* (2006.01)
*C23C 18/08* (2006.01)

(52) U.S. Cl.
CPC ..... *C23C 18/08* (2013.01)

(58) Field of Classification Search
CPC ..... C23C 18/08
See application file for complete search history.

(56) References Cited

U.S. PATENT DOCUMENTS 5,763,633 A * 6/1998 Vaartstra ..... H01L 21/28556 556/136
2013/0202795 A1 8/2013 Wu

FOREIGN PATENT DOCUMENTS

DE 102014222996 A1 5/2016
WO 9007561 A1 7/1990
WO 2012167198 A2 12/2012
WO WO-2019120650 A1 * 6/2019 ..... C07F 5/067

OTHER PUBLICATIONS

2-EHA, Fuchs Lubricantes, downloaded Aug. 16, 2024.*
Sigma-Aldrich, 2-Ethylhexanoinic acid Safety Data Sheet, Sep. 9, 2024.

* cited by examiner

*Primary Examiner* — Yong L Chu
(74) *Attorney, Agent, or Firm* — Blank Rome LLP

(57) ABSTRACT

A preparation containing:

(A) 30 to 90 wt. % of at least one organic solvent, (B) 10 to 70 wt. % of at least one noble metal complex comprising diolefin and C6-C18 monocarboxylate ligands selected from the group consisting of noble metal complexes of the type $[LPd[O(CO)R1]X]_n$, $[LRh[O(CO)R1]]_m$, and $[LIr[O(CO)R1]]_m$, wherein L represents a compound acting as diolefin ligand, wherein X is selected among bromide, chloride, iodide, and —O(CO)R2, wherein —O(CO)R1 and —O(CO)R2 represent identical or different non-aromatic C6-C18 monocarboxylic acid residues, and wherein n is an integral number 1, and m is an integral number ≥2, and (C) 0 to 10 wt. % of at least one additive.

22 Claims, No Drawings

PREPARATIONS OF NOBLE METAL COMPLEXES

The present invention relates to preparations of noble metal complexes and the use of the preparations for the production of noble metal-comprising layers on substrates.

WO90/07561 A1 discloses platinum complexes with the formal $LM[O(CO)R]_2$, wherein L stands for a nitrogen-free cyclical polyolefin ligand, preferably cyclooctadiene (COD) or pentamethyl cyclopentadiene, and M stands for platinum or iridium, and wherein R represents benzyl, aryl, or alkyl with four or more carbon atoms, particularly preferably phenyl. It was the object of the present invention to find preparations, which can be used for the production of noble-metal-comprising layers, in particular also on temperature-sensitive substrates.

The object can be solved by providing preparations of noble metal complexes of palladium, of rhodium or iridium, respectively, each comprising diolefin and C6-C18 monocarboxylate ligands. More precisely, what is provided are preparations containing or consisting of:

(A) 30 to 90 wt. % (percent by weight) of at least one organic solvent, (B) 10 to 70 wt. % of at least one noble metal complex comprising diolefin and C6-C18 monocarboxylate ligands selected from the group consisting of noble metal complexes of the type $[LPd[O(CO)R1]X]_n$, $[LRh[O(CO)R1]]_m$ and $[LIr[O(CO)R1]]_m$, wherein L represents a compound acting as diolefin ligand, wherein X is selected among bromide, chloride, iodide, and —O(CO)R2, wherein —O(CO)R1 and —O(CO)R2 represent identical or different non-aromatic C6-C18 monocarboxylic acid residues, in each case preferably with the exception of a phenylacetic residue, and wherein n is an integral number ≥1, and m is an integral number ≥2, and (C) 0 to 10 wt. % of at least one additive.

The expression "compound acting as diolefin ligand" used herein refers to a compound, which, in the noble metal complexes, provides its two or two of its olefinic double bonds with a noble metal central atom so as to form a complex or with two noble metal central atoms in a bridging manner so as to form a complex.

In the case of polynuclear noble metal complexes, the numbers n and m generally represent an integral number, for example in the range of 2 to 5. In other words, integral n>1 generally lies in the range of 2 to 5; n is then in particular equal to 2, and the noble metal complexes are then binuclear palladium complexes. Integral m generally also lies in the range of 2 to 5; m is then in particular equal to 2, and the noble metal complexes are then binuclear rhodium or iridium complexes.

In the preparations according to the invention, the component (B) is present in dissolved form in component (A). In the presence of the optional component (C) in a preparation according to the invention, this component (C) is preferably also present in dissolved form in component (A). In other words, in the absence of the optional component (C), the preparations according to the invention are organic solutions, more precisely, genuine, i.e. non-colloidal organic solutions; the same applies in the presence of the optional component (C) in the preferred form, i.e. in the dissolved form in component (A).

The preparations according to the invention contain 30 to 90 wt. % of at least one organic solvent (A). The organic solvent or solvents can be selected from a plurality of common organic solvents because the noble metal complexes are of high to unlimited solubility in such organic solvents. Advantageously, the organic solvent or solvents are essentially volatile under the processing conditions of the preparations according to the invention, this applies in particular for the stage after application of a preparation according to the invention to a substrate. The boiling points of the organic solvent or solvents generally lie in a range of 50 to 200° C. or higher, for example 50 to 300° C. Examples for organic solvents (A) comprise aliphatics and cycloaliphatics, each with 6 to 12 carbon atoms; halogenated hydrocarbons, such as di-, tri- and tetrachloromethane; aromatic compounds; araliphatics, such as toluene or xylol; alcohols, such as ethanol, n-propanol, and isopropanol; ether; glycol ethers, such as mono-C1-C4 alkylene glycol ether, and Di-C1-C4 alkylene glycol ether, for example ethylene glycol mono-C1-C4 alkylene ether, ethylene glycol di-C1-C4 alkylene ether, diethylene glycol mono-C1-C4 alkylene ether, diethylene glycol di-C1-C4 alkylene ether, propylene glycol mono-C1-C4 alkylene ether, propylene glycol di-C1-C4 alkylene ether, dipropylene glycol imono-C1-C4 alkylene ether, and dipropylene glycol di-C1-C4 alkylene ether; esters with 2 to 12 carbon atoms; and ketones, such as acetone, methylethylketone, methylisobutylketone, and cyclohexanone. Araliphatics, such as toluene or xylol, alcohols, such as ethanol, n-propanol and isopropanol, and glycol ethers, such as mono-C1-C4 alkylene glycol ether and Di-C1-C4 alkylene ether, for example ethylene glycol mono-C1-C4 alkylene ether, ethylene glycol di-C1-C4 alkylene ether, diethylene glycol mono-C1-C4 alkylene ether, diethylene glycol Di-C1-C4 alkylene ether, propylene glycol mono-C1-C4 alkylene ether, propylene glycol di-C1-C4 alkylene ether, dipropylene glycol mono-C1-C4 alkylene ether, and dipropylene glycol di-C1-C4 alkylene ether are preferred thereby. Component (A) or the at least one organic solvent (A), respectively, particularly preferably consists of at least one alcohol, specifically at least one of the alcohols mentioned in an exemplary manner, and/or of at least one glycol ether, specifically at least one of the glycol ethers mentioned in an exemplary manner. Corresponding mixtures of 30 to 70 parts by weight of alcohol and the part by weight of glycol ether, 100 parts by weight of which are absent, are in particular preferred as component (A).

As already mentioned, the preparations according to the invention contain 10 to 70 wt. % of at least one noble metal complex with diolefin and C6-C18 monocarboxylate ligands selected from the group consisting of noble metal complexes of the type $[LPd[O(CO)R1]X]_n$, $[LRh[O(CO)R1]]_m$, and $[LIr[O(CO)R1]]_m$ as component (B), wherein L represents a compound acting as diolefin ligand, wherein X is selected from bromide, chloride, iodide, and —O(CO)R2, wherein —O(CO)R1 and —O(CO)R2 represent identical or different non-aromatic C6-C18 monocarboxylic acid residues, in each case preferably with the exception of a phenylacetic residue, and wherein n is an integral number 1, and m is an integral number ≥2.

The noble metal content of a preparation according to the invention originating from the at least one mobile metal complex can lie in the range of, for example, 2.5 to 25 wt. %.

In the case of the embodiment of mono-nuclear palladium complexes of the type [LPd[O(CO)R1]X], L is a compound acting as diolefin ligand at the palladium central atom; X represents bromide, chloride, iodide, or —O(CO)R2; and —O(CO)R1 and —O(CO)R2 represent identical or different non-aromatic C6-C18 monocarboxylic acid residues, in each case preferably with the exception of a phenylacetic residue. n is equal to 1 here.

In the case of a preferred embodiment of bi- or multinuclear palladium complexes of the type [LPd[O(CO)R1]

$X]_n$, L represents a compound acting as diolefin ligand; X represents bromide, chloride, iodide, or —O(CO)R2; n represents 2, 3, 4, or 5, preferably 2; and —O(CO)R1 and —O(CO)R2 represent identical or different non-aromatic C6-C18 monocarboxylic acid residues, in each case preferably with the exception of a phenylacetic residue.

In the case of a preferred embodiment of bi- or multinuclear noble metal complexes of the type $[LRh[O(CO)R1]]_m$ or $[LIr[O(CO)R1]]_m$, respectively, L represents a compound acting as diolefin ligand; m represents 2, 3, 4, or 5, preferably 2; and —O(CO)R1 represents a non-aromatic C6-C18 monocarboxylic acid residue, preferably with the exception of a phenylacetic residue.

However, said noble metal complexes can also be present in the preparations according to the invention in individualized, but also in associated form, thus alone or also as mixture of several different species. Palladium complexes can thus be present in the preparations according to the invention in individualized or in associated form, thus alone or as mixture of several difference species, in each case of the type $[LPd[O(CO)R1]X]_n$. Rhodium complexes can also be present in the preparations according to the invention in individualized or in associated form, thus alone or as mixture of several, different specifies, in each case of the type $[LRh[O(CO)R1]]_m$. No differently, iridium complexes can also be present in the preparations according to the invention in individualized or in associated form, thus alone or as mixture of several different species, in each case of the type $[LIr[O(CO)R1]]_m$. In other words, component (B) can comprise compounds of the type $[LPd[O(CO)R1]X]_n$ and/or of the type $[LRh[O(CO)R1]]_m$, and/or of the type $[LIr[O(CO)R1]]_m$; component (B) can therefore comprise compounds of only one of the types, of two of the types, or of all three of the types disclosed here, wherein the respective type can be represented in only one individual form (individualized) or in more than one individual form (associated). The term "individual form" used in this context here refers to the formula type with concrete index n or m, respectively; for example, $[LRh[O(CO)R1]]_2$ is the individual form of the general type $[LRh[O(CO)R1]]_m$ with m=2.

The compositions according to the invention can also comprise platinum compounds of the type $[LPt[O(CO)R1]X]_n$. In such platinum complexes, n has the same meaning as in the palladium complexes of the type $[LPd[O(CO)R1]X]_n$. Such platinum compounds are disclosed in the PCT application with the filing number PCT/EP2020/068465.

Examples for diolefins or for compounds of the type L, respectively, which are able to act as diolefin ligands, comprise hydrocarbons, such as COD (1.5-cyclooctadien), NBD (norbornadiene), COT (cyclooctatetraene), and 1.5-hexadien, in particular COD and NBD. They are preferably pure hydrocarbons; however, the presence heteroatoms, for example also in the form of functional groups, is also possible.

X can represent bromide, chloride, iodide, or —O(CO)R2, it preferably represents chloride or —O(CO)R2, in particular —O(CO)R2.

The respective non-aromatic monocarboxylic acid residues —O(CO)R1 and —O(CO)R2 represent identical or different non-aromatic C6-C18 monocarboxylic acid residues, in each case preferably with the exception of a phenylacetic residue. The term "non-aromatic" used in this context excludes purely aromatic monocarboxylic acid residues, but not araliphatic monocarboxylic acid residues, the carboxyl function(s) of which is/are bound to aliphatic carbon. —O(CO)R1 as well as —O(CO)R2 preferably do not represent a phenylacetic residue. —O(CO)R1 and —O(CO)R2 preferably represent identical non-aromatic C6-C18-monocarboxylic acid residues, but preferably no phenylacetic residues thereby. Monocarboxylic acid residues with 8 to 18 carbon atoms, i.e. non-aromatic C8-C18 monocarboxylic acid residues, are preferred among the non-aromatic C6-C18 monocarboxylic acid residues.

Examples for non-aromatic C6-C18- or the preferred C8-C18 monocarboxylic acids with residues of —O(CO)R1 or —O(CO)R2, respectively, comprise the isomeric hexanoic acids including n-hexanoic acid, the isomeric heptanoic acids including n-heptanoic acid, the isomeric octanoic acids including n-octanoic acid and 2-ethylhexanoic acid, the isomeric nonanoic acids including n-nonanoic acid, and the isomeric decanoic acids including n-decanoic acid, to name just a few examples. Not only linear representatives, but also those with branches and/or cyclical structures are captured, such as, for example, 2-ethyl hexanoic acid, cyclohexanecarboxylic acid, and neodecanoic acid. The residues R1 and R2, which are in each case bound to a carboxyl group, comprise 5 to 17 or 7 to 17 carbon atoms, respectively; benzyl residues are thereby preferably excluded in each case.

Preferred examples for palladium complexes comprise $[(COD)Pd[O(CO)R1]_2]_n$ and $[(NBD)Pd[O(CO)R1]_2]_n$, wherein n is equal to 1 or 2 and in particular equal to 1, and wherein R1 stands for a non-aromatic C5-C17 hydrocarbon residue, in each case preferably with the exception of benzyl.

Preferred examples for rhodium complexes comprise $[(COD)Rh[O(CO)R1]]_m$, and $[(NBD)Rh[O(CO)R1]]_m$, wherein m is equal to 2, and wherein R1 stands for a non-aromatic C5-C17 hydrocarbon residue, in each case preferably with the exception of benzyl.

Preferred examples for iridium complexes comprise $[(COD)Ir[O(CO)R1]]_m$, and $[(NBD)Ir[O(CO)R1]]_m$, wherein m is equal to 2, and wherein R1 stands for a non-aromatic C5-C17 hydrocarbon residue, in each case preferably with the exception of benzyl.

The noble metal complexes can be produced in a simple way by means of ligand exchange, in particular without thereby using carboxylic acid salts of the silver. The production process comprises a mixing or suspending, respectively, or emulsifying of a two-phase system. The one phase thereby comprises a starting material of the type $LPdX_2$ or $[LRhX]_2$, respectively, or $[LIrX]_2$, with X in each case selected among bromide, chloride, and iodide, preferably chloride, either as such or preferably in the form of an at least essentially non-water-miscible organic solution of such a starting material. In addition to aromatics and chlorinated hydrocarbons, such as toluene, xylene, dichloromethane, trichloromethane, and tetrachloromethane, examples for organic solvents, which are suitable for the production of an organic solution of this type and which are at least essentially non-water-miscible, also comprise oxygenated solvents, for example corresponding non-water-miscible ketones, ester, and ether. The other phase, in contrast, comprises, for example, an aqueous solution of alkaline salt (in particular sodium or potassium salt) and/or of magnesium salt of a C6-C18 monocarboxylic acid of the type R1COOH as well as optionally additionally of the type R2COOH. The selection of the type of the monocarboxylic salt or salts depends on the type of the noble metal complexes to be produced or on the association of noble metal complexes to be produced. The two phases are mixed intensively by forming a suspension or emulsion, for example by means of shaking and/or stirring. For the purpose of maintaining the suspension or emulsion state, the mixing is carried out, for example, for a time period of 0.5 to 24 hours, for example at a temperature in the range of 20 to 50° C. The ligand exchange takes place thereby, wherein the formed noble metal complex or complexes dissolve in the organic phase, while the likewise formed alkali X salt or $MgX_2$ salt dissolves in the aqueous phase. After completion of suspension or emulsion, organic and aqueous phase are separated from one another. The formed noble metal complex or complexes can be obtained from the organic phase and can optionally be purified subsequently by means of common methods.

To mention just one concrete example, (COD)Pd[O(CO)CH($C_2H_5$)$C_4H_9$]$_2$ can thus for example be produced by means of common emulsifying of a solution of (COD)Pd$Cl_2$ in dichloromethane with an aqueous solution of sodium-2-ethylhexanoate. After emulsifying has ended, the sodium chloride-containing solution formed by means of ligand exchange can thereby be separated from the dichloromethane phase, and from the latter, the (COD)Pd[O(CO)CH($C_2H_5$)$C_4H_9$]$_2$ can be isolated and can optionally be purified by means of common purification processes. For example in the case of correspondingly selected stoichiometry, the palladium complex (COD)Pd[O(CO)CH($C_2H_5$)$C_4H_9$]Cl can also be produced analogously.

In addition to the above-mentioned solubility in common organic solvents, the comparatively low decomposition temperature of the noble metal complex or complexes of the component (B), for example already starting at 150° C. to 250° C., often not higher than 200° C., is an important property. This property combination makes it possible to use such noble metal complexes as component (B) of the preparations according to the invention for the production of noble metal-comprising layers on substrates; in the case of this type of use, the preparation according to the invention represents a coating agent, i.e. it is then prepared and can be used as covering agent.

The preparations according to the invention contain 0 to 10 wt. %, preferably 0 to 3 wt. %, of at least one additive (C). The preparations according to the invention can therefore be additive-free or can contain up to 10 wt. % of at least one additive. Examples for additives comprise wetting additives, rheology additives, defoamers, deaerators, additives for influencing the surface tension, and odorants.

Preparations according to the invention can be produced by means of a simple mixing of the components (A), (B), and, if desired, (C). The expert thereby selects the proportion of the components, adapted to the respective intended purpose and/or the application method used thereby.

The preparations according to the invention can be used for the production of noble metal-comprising layers on substrates, in particular also on temperature-sensitive substrates. The preparations according to the invention can thereby initially be used for the production of covering layers (coatings), which can subsequently be subjected to a thermal decomposition. When working with preparations according to the invention based on palladium complexes of the type [LPd[O(CO)R1]X]$_n$, an essentially metallic palladium in the form of a layer forms in response to the thermal decomposition even in the presence of air as surrounding atmosphere; in response to the thermal decomposition when working with preparations according to the invention on the basis of rhodium complexes of the type [LRh[O(CO)R1]]$_n$ or on the basis of iridium complexes of the type [LIr[O(CO)R1]]$_n$, respectively, in contrast, essentially corresponding noble metal oxide layers or even noble metal oxide layers, which are free from the corresponding metallic noble metal, form in the presence of air as surrounding atmosphere. In this regard, the expert understands the expression "noble metal-comprising layer" used herein as layer comprising essentially or even only metallic palladium or consisting thereof, as layer comprising essentially or even only rhodium oxide or consisting thereof, or as layer comprising essentially or even only iridium oxide or consisting thereof, in short, as a layer comprising or consisting of metallic palladium, rhodium oxide, or iridium oxide. While according to the invention, palladium layers, which, according to the invention, can be obtained on substrates, can display properties, which can be expected by the expert, layers which can be obtained on substrates and which comprise essentially rhodium oxide or essentially iridium oxide, respectively, or substrate surfaces equipped therewith, respectively, can have interesting electrical properties.

If the preparations according to the invention comprise a combination of two or several of the noble metal complex types disclosed herein as component (B), optionally additionally combined with one or several of the above-mentioned platinum complexes of the type [LPt[O(CO)R1]X]$_n$, or a combination of a noble metal complex type disclosed herein as component (B) with one or several of the above-mentioned platinum complexes of the type [LPt[O(CO)R1]X]$_n$, layers comprising more than one noble metal can also be produced on substrates quasi simultaneously. The proportions of metallic palladium, rhodium oxide, iridium oxide, as well as optionally also captured metallic platinum in a respective layer can thereby be set variably in a very simple manner via the respective proportions of the noble metal complexes in a preparation according to the invention, which is used for the production of a respective layer. In particular the following types of layers comprising more than one noble metal can be generated on substrates:

- layer comprising metallic palladium and metallic platinum, for example in the form of platinum/palladium alloys,
- layer comprising metallic palladium and rhodium oxide,
- layer comprising metallic palladium and iridium oxide,
- layer comprising metallic palladium, rhodium oxide, and iridium oxide,
- layer comprising metallic platinum and rhodium oxide,
- layer comprising metallic platinum and iridium oxide,
- layer comprising metallic platinum, rhodium oxide, and iridium oxide,
- layer comprising metallic palladium, metallic platinum, and rhodium oxide,
- layer comprising metallic palladium, metallic platinum, and iridium oxide,
- layer comprising metallic palladium, metallic platinum, rhodium oxide, and iridium oxide,
- layer comprising rhodium oxide and iridium oxide, without metallic palladium and without metallic platinum.

In response to the thermal treatment, the coating layers decompose as mentioned above under formation of noble metal-comprising layers, i.e. the coating layers are ultimately transferred into noble metal-comprising layers. The invention thus also relates to a method for the production of a noble metal-comprising layer on a substrate, comprising the steps of:

(1) application of a covering layer of a preparation according to the invention to a substrate, and (2) thermal decomposition of the covering layer by forming the noble metal-comprising layer.

The substrates, which are to be provided with the covering layer in step (1), can be substrates, which comprise a wide variety of materials. The substrates can thereby comprise only one or also several materials. Examples for materials comprise, among others, glass; carbide substrates, such as, for example, titanium carbide, molybdenum carbide, tungsten carbide, silicon carbide; nitride substrates, such as, for example, aluminum nitride, titanium nitride, silicon nitride; boride substrates, such as, for example, titanium boride, zirconium boride; ceramic substrates, including those on the basis of oxidic ceramic and those, which are common as catalyst support in heterogeneous catalysts; semiconductor substrates, such as, for example, silicon substrates; metal; plastic; modified or unmodified polymers of natural origin; carbon substrates; wood; cardboard and paper. The substrates can be provided with the coating layer on inner and/or outer surfaces and/or on inner and/or outer surface portions.

In the case of the production of the coating layer according to step (1), application methods known per se can also be used.

A first application method is the immersion. The substrate, which is to be provided with the covering layer or the substrate, which is to finally be provided with the noble metal-comprising layer, respectively, is thereby immersed in and removed from the preparation according to the invention. The percentage of component (A) during immersion preferably lies in the range of 30 to 90 wt. % of the preparation according to the invention, and the percentage of component (B) lies in the range of 10 to 70 wt. %.

A second application method is the spray application. The substrate, which is to be provided with the coating layer or the substrate, which is to finally be provided with the noble metal-comprising layer, respectively, is thereby spray-coated with the preparation according to the invention by using a common spray-coating tool. Examples for spray-coating tools are pneumatic spray guns, airless spray guns, rotary atomizers, or the like. The percentage of component (A) during the spray application preferably lies in the range of 50 to 90 wt. % of the preparation according to the invention, and the percentage of component (B) lies in the range of 10 to 50 wt. %

A third application method is the printing. The substrate, which is to be provided with the covering layer or the substrate, which is to finally be provided with the noble metal-comprising layer, respectively, is thereby imprinted with the preparation according to the invention. A preferred printing method is thereby the inkjet printing; the preparation according to the invention represents a covering agent in the form of an ink here. A further preferred printing method is the screen printing. The percentage of component (A) during the printing preferably lies in the range of 50 to 90 wt. % of the preparation according to the invention, and the percentage of component (B) lies in the range of 10 to 50 wt. %.

A fourth application method is the application by means of an application tool, which is soaked with the preparation according to the invention, for example a paint brush, a brush, a felt, or a cloth. The application tool thereby transfers the preparation according to the invention to the substrate, which is to be provided with the coating layer or to the substrate, which is to finally be provided with the noble metal-comprising layer, respectively. In the case of an application technique of this type, the percentage of component (A) preferably lies in the range of 30 to 90 wt. % of the preparation according to the invention, and the percentage of component (B) lies in the range of 10 to 70 wt. %.

The applied covering layer from a preparation according to the invention and comprising the at least one component (B), can initially be dried and can thereby be partially or completely freed from the organic solvent (A), before it or the dried residue, respectively, is subjected to a thermal decomposition by forming the noble metal-comprising layer.

The thermal treatment, which takes place for the purpose of thermal decomposition, comprises a heating to an object temperature above the decomposition temperature of the at least one noble metal complex (B). In the presence of several different noble metal complexes (B), the expert will select the object temperature above the decomposition temperature of the noble metal complex of type (B) with the highest decomposition temperature. For example, a heating to an object temperature above the decomposition temperature generally takes place briefly for this purpose, for example for a time period of 1 minute to 30 minutes to an object temperature in the range of >150° C. to 200° C. or of >150 to 250° C. or higher, for example up to 1000° C. The heating can in particular take place in a furnace and/or by means of infrared radiation.

Generally, an object temperature slightly above the respective decomposition temperature is selected. Generally, the heating, more precisely, the maintaining of the object temperature, does not take more than 15 minutes.

It is advantageous, in particular when working with the embodiment of preparations according to the invention on the basis of palladium complexes of the type $[LPd[O(CO)R1]X]_n$ that no preparations containing colloidal palladium or nanopalladium have to be used, so that possible risks associated therewith can be avoided.

In the case of the second and third of the above-mentioned application methods, a clogging of the application tools, more precisely, the clogging of fine openings or nozzles of spray application tools or inkjet nozzles, respectively, can be avoided with the use of the preparations according to the invention; finally, the question of, for example, colloidal palladium or nanopalladium, which begins to dry or which aggregates, does not arise here.

Palladium layers, which can be obtained according to the invention, are characterized by high metallic gloss comparable with a mirror, provided that work is performed with substrates having smooth surfaces, which are not too rough; the palladium layers are thereby homogenous in terms of a smooth, non-granular outer surface.

The thickness of noble metal-comprising layers, which can be obtained according to the invention, can lie, for example, in the range of 50 nm to 5 μm, and the noble metal-comprising layers can be of a flat nature with or without desired interruptions within the surface area, or can have a desired pattern or design. As can be seen from the above-mentioned examples for substrates, the noble metal-comprising layers can even be generated on temperature-sensitive substrates, i.e. for example on substrates, which are not temperature-stable above 200° C.; for example, these can be temperature-sensitive polymer substrates, for examples those on the basis of polyolefin or polyester.

EXAMPLES

Example 1 (Equipping of a Polyimide Film with a Palladium Layer):

A solution of 35 mmol $(COD)PdCl_2$ in 200 ml of dichloromethane was stirred, and a solution of 140 mmol of sodium-2-ethylhexanoate in 150 ml of water was added. The two-phase mixture was emulsified for 24 h at 20° C. by means of intensive stirring. The dichloromethane phase turned yellow thereby.

The dichloromethane phase was separated, and the solvent was distilled off. The viscous, yellow residue was received in petroleum benzine (40-60) and the solution was dried and filtered with magnesium sulphate. The petroleum benzine was then distilled off completely. What remained was a viscous yellow residue of $(COD)Pd[O(CO)CH(C_2H_5)C_4H_9]_2$.

5 g of the yellow residue were dissolved in 5.60 g of a solvent mixture (50 wt. % of ethanol, 50 wt. % of propylene glycol monopropylether). This solution was sprayed onto a Kapton® film (polyimide) by means of an airbrush spray gun. The coated film was heated to an object temperature of 200° C. in a laboratory furnace and was kept at this temperature for 5 minutes. A glossy electrically conductive layer of palladium had formed on the film.

Example 2 (Equipping of a Polyimide Film with a Patterned Palladium Layer):

A Kapton® film was imprinted with the solution from Example 1 with the help of an inkjet printer at a resolution of 1270 dpi in a meander design. The film imprinted in this way was heated to an object temperature of 200° C. in a laboratory furnace and was kept at this temperature for 5 minutes. A glossy electrically conductive layer of palladium in the form of the meander design with a width of the conductor paths of 2.5 mm had formed on the film.

Example 3 (Equipping of a Polyimide Film with a Palladium Layer):

Example 1 was repeated completely analogously with the sole difference that $(NBD)PdCl_2$ was used instead of $(COD)PdCl_2$, so that a yellow residue of $(NBD)Pd[O(CO)CH(C_2H_5)C_4H_9]_2$ and finally a polyimide film, which was provided with a palladium layer and which corresponded to the coated film obtained in Example 1, was obtained as result of the synthesis.

Example 4 (Equipping of a Polyimide Film with a Patterned Palladium Layer):

Example 2 was repeated completely analogously, with the sole difference that $(NBD)PdCl_2$ was used instead of $(COD)PdCl_2$, so that a yellow residue of $(NBD)Pd[O(CO)CH(C_2H_5)C_4H_9]_2$ and finally a polyimide film, which was provided with a patterned palladium layer and which corresponded to the film obtained in Example 2, which was provided with a patterned palladium layer, was obtained as result of the synthesis.

Example 5 (Equipping of a Polyimide Film with a Rhodium Oxide Layer):

A solution of 16.3 mmol $[(COD)RhCl]_2$ in 200 ml of dichloromethane was stirred, and a solution of 65.3 mmol of sodium-2-ethylhexanoate in 100 ml of water was added. The two-phase mixture was emulsified for 24 h at 20° C. by intensive stirring. The dichloromethane phase turned yellow thereby.

The dichloromethane phase was separated, and the solvent was distilled off. The viscous, yellow residue was received in petroleum benzine (40-60) and the solution was dried and filtered with magnesium sulphate. The petroleum benzine was then distilled off completely. What remained was a viscous yellow residue of $$[(COD)Rh[O(CO)CH(C_2H_5)C_4H_9]]_m.$$

5 g of the yellow residue were dissolved in 5 g of petroleum benzine. This solution was sprayed onto a Kapton® film by means of an airbrush spray gun. The coated film was heated to an object temperature of 250° C. in a laboratory furnace and was kept at this temperature for 3 minutes. A matte layer of essentially rhodium oxide had formed on the film.

Example 6 (Equipping of a Polyimide Film with a Patterned Rhodium Oxide Layer):

A Kapton® film was imprinted with the solution from Example 5 with the help of an inkjet printer at a resolution of 1270 dpi in a meander design. The film imprinted in this way was heated to an object temperature of 250° C. in a laboratory furnace and was kept at this temperature for 5 minutes. A matte layer of essentially rhodium oxide in the form of the meander design with a width of the conductor paths of 2.5 mm had formed on the film.

Example 7 (Equipping of a Polyimide Film with a Rhodium Oxide Layer):

Example 5 was repeated completely analogously, with the sole difference that $[(NBD)RhCl]_2$ was used instead of $[(COD)RhCl]_2$, so that a yellow residue of $[(NBD)Rh[O(CO)CH(C_2H_5)C_4H_9]]_m$ and finally a polyimide film, which was provided with a matte layer of essentially rhodium oxide and which corresponded to the coated film obtained in Example 5, was obtained as result of the synthesis.

Example 8 (Equipping of a Polyimide Film with a Patterned Rhodium Oxide Layer):

Example 6 was repeated completely analogously, with the sole difference that $[(NBD)RhCl]_2$ was used instead of $[(COD)RhCl]_2$, so that a yellow residue of $[(NBD)Rh[O(CO)CH(C_2H_5)C_4H_9]]_m$ and finally a polyimide film, which was provided with a patterned layer of essentially rhodium oxide and which corresponded to the film obtained in Example 6, which was provided with a patterned layer of essentially rhodium oxide, was obtained as result of the synthesis.

Example 9 (Equipping a Polyimide Film with an Iridium Oxide Layer):

A solution of 16.3 mmol $[(COD)IrCl]_2$ in 200 ml of dichloromethane was stirred, and a solution of 65.3 mmol of sodium neodecanoate in 100 ml of water was added. The two-phase mixture was emulsified for 24 h at 20° C. by intensive stirring. The dichloromethane phase turned yellow thereby.

The dichloromethane phase was separated, and the solvent was distilled off. The viscous, yellow residue was received in petroleum benzine (40-60) and the solution was dried and filtered with magnesium sulphate. The petroleum benzine was then completely distilled off. What remained was a viscous yellow residue of $$[(COD)Ir[O(CO)(CH_2)_5C(CH_3)_3]]_m.$$

5 g of the yellow residue were dissolved in 5 g of petroleum benzine. This solution was sprayed onto a Kapton® film by means of an airbrush spray gun. The coated film was heated to an object temperature of 250° C. in a laboratory furnace and was kept at this temperature for 3 minutes. A matte layer of essentially iridium oxide had formed on the film.

Example 10 (Equipping of a Polyimide Film with a Patterned Iridium Oxide Layer):

A Kapton® film was imprinted with the solution from Example 9 with the help of an inkjet printer at a resolution of 1270 dpi in a meander design. The film imprinted in this way was heated to an object temperature of 250° C. in a laboratory furnace and was kept at this temperature for 5 minutes. A matte layer of essentially iridium oxide in the form of the meander design with a width of the conductor paths of 2.5 mm had formed on the film.

The invention claimed is:

1. A preparation consisting of:

(A) 30 to 90 wt. % of at least one organic solvent, the at least one organic solvent having a boiling point ranging from 50 to 200° C., (B) 10 to 70 wt. % of at least one noble metal complex comprising diolefin and $C_6$-$C_{18}$ monocarboxylate ligands selected from the group consisting of noble metal complexes of the type $[LPd[O(CO)R1]X]_n$, $[LRh[O(CO)R1]]_m$ and $[LIr[O(CO)R1]]_m$, wherein L represents a compound acting as diolefin ligand, wherein X is selected among bromide, chloride, iodide, and —O(CO)R2, wherein —O(CO)R1 and —O(CO)R2 represent identical or different non-aromatic monocarboxylic acid residues with each of R1 and R2 being a $C_5$-$C_{17}$ hydrocarbon residue, and wherein n is an integral number ≥1, and m is an integral number ≥2, and (C) 0 to 10 wt. % of at least one additive selected from the group consisting of wetting additives, rheology additives, defoamers, deaerators, additives for influencing the surface tension, and odorants, wherein the preparation is in the form of an organic solution.

2. The preparation according to claim 1, wherein the integral n>1 and the integral m lies in the range of 2 to 5.

3. The preparation according to claim 1, wherein the preparation is in the form of a non-colloidal organic solution.

4. The preparation according to claim 1, wherein a noble metal content originating from the at least one mobile metal complex in the range of 2.5 to 25 wt. %.

5. The preparation according to claim 1, wherein the at least one noble metal complex is selected among noble metal complexes of the type $[(COD)Pd[O(CO)R1]_2]_n$, $[(NBD)Pd[O(CO)R1]_2]_n$, $[(COD)Rh[O(CO)R1]]_m$, $[(NBD)Rh[O(CO)R1]]_m$, $[(COD)Ir[O(CO)R1]]_m$, and $[(NBD)Ir[O(CO)R1]]_m$, wherein n is equal to 1 or 2, and wherein m is equal to 2.

6. The preparation according to claim 1, wherein the at least one noble metal complex exhibits a decomposition temperature in the range of 150 to 200° C.

7. A method for the production of a noble metal-comprising layer on a substrate, the method comprising:

(1) applying a covering layer of a preparation according to claim 1 to the substrate, and (2) thermally decomposing the covering layer by forming the noble metal-comprising layer.

8. The method according to claim 7, wherein the substrate comprises one or more materials selected from the group consisting of glass, carbide substrates, nitride substrates, boride substrates, ceramic substrates, semiconductor substrates, metal, plastics, modified or unmodified polymers of natural origin, carbon substrates, wood, cardboard and paper.

9. The method according to claim 7, wherein the substrate is provided with the coating layer on an inner and/or outer surface and/or on an inner and/or an outer surface portion.

10. The method according to claim 7, wherein the covering layer applied in step (1) is initially dried and is thereby partially or completely freed from the organic solvent (A), before it is subjected to the thermal decomposition in step (2).

11. The method according to claim 7, wherein the noble metal-comprising layer has a thickness of from 50 nm to 5 μm.

12. The method according to claim 7, wherein the noble metal-comprising layer is a layer comprising metallic palladium, rhodium oxide, or iridium oxide.

13. The preparation according to claim 1, wherein the at least one noble metal complex exhibits a decomposition temperature in the range of from 150 to 250° C.

14. The preparation according to claim 1, wherein at least one of R1 and R2 is a $C_7$-$C_{17}$ hydrocarbon residue.

15. The preparation according to claim 1, wherein at least one of R1 and R2 is a $C_5$-$C_{17}$ hydrocarbon residue is a linear hydrocarbon structure.

16. The preparation according to claim 1, wherein R1 and R2 have different chemical structures.

17. A preparation consisting of:

(A) 30 to 90 wt. % of at least one organic solvent, the at least one organic solvent having a boiling point ranging from 50 to 200° C., (B) 10 to 70 wt. % of at least one noble metal complex that exhibits a decomposition temperature ranging from 150 to 250° C., the at least one noble metal complex comprising diolefin and $C_6$-$C_{18}$ monocarboxylate ligands selected from the group consisting of noble metal complexes of the type $[LPd[O(CO)R1]X]_n$, $[LRh[O(CO)R1]]_m$ and $[LIr[O(CO)R1]]_m$, wherein L represents a compound acting as diolefin ligand, wherein X is selected among bromide, chloride, iodide, and —O(CO)R2, wherein —O(CO)R1 and —O(CO)R2 represent identical or different non-aromatic monocarboxylic acid residues with each of R1 and R2 being a $C_5$-$C_{17}$ hydrocarbon residue, and wherein n is an integral number ≥1, and m is an integral number ≥2, and (C) up to 10 wt. % of at least one additive selected from the group consisting of wetting additives, rheology additives, defoamers, deaerators, additives for influencing the surface tension, and odorants.

18. The preparation of claim 1, wherein the at least one solvent is not a ketone.

19. The preparation of claim 1, wherein the at least one solvent is selected from the group consisting of halogenated hydrocarbons, aromatic compounds, araliphatics, alcohols, ethers, glycol ethers, and any combination thereof.

20. The preparation of claim 1, wherein the at least one solvent is selected from the group consisting of halogenated hydrocarbons, alcohols, glycol ethers, and any combination thereof.

21. The preparation according to claim 1, wherein the at least one noble metal complex is selected among noble metal complexes of the type [(COD) Pd [O (CO) R1] 2] n, $[(NBD)Pd[O(CO)R1]_2]_n$, $[(COD)Rh[O(CO)R1]]_m$, $[(NBD)Rh[O(CO)R1]]_m$, and $[(NBD)Ir[O(CO)R1]]_m$, wherein n is equal to 1 or 2, and wherein m is equal to 2.

22. The preparation according to claim 1, wherein the at least one noble metal complex is selected among noble metal complexes of the type $[(NBD)Pd[O(CO)R1]_2]_n$, $[(NBD)Rh[O(CO)R1]]_m$, and $[(NBD)Ir[O(CO)R1]]_m$, wherein n is equal to 1 or 2, and wherein m is equal to 2.

* * * * *